United States Patent [19]

Nottingham et al.

[11] Patent Number: 4,898,561

[45] Date of Patent: Feb. 6, 1990

[54] SELF-INFLATING TOY

[76] Inventors: John R. Nottingham, 60 Stonewood Dr.; John Spirk, 50 Stonewood Dr., both of Moreland Hills, Ohio 44022

[21] Appl. No.: 331,081

[22] Filed: Mar. 27, 1989

Related U.S. Application Data

[63] Continuation of Ser. No. 103,025, Sep. 30, 1987, abandoned, which is a continuation of Ser. No. 879,915, Jun. 27, 1986, abandoned.

[51] Int. Cl.[4] ..... A63H 33/00

[52] U.S. Cl. ..... 446/220; 446/226

[58] Field of Search ..... 446/220, 221, 226

[56] References Cited

U.S. PATENT DOCUMENTS

| | | | |
|---|---|---|---|
| 494,410 | 3/1893 | Carpenter . | |
| 1,216,425 | 2/1917 | Eiseman . | |
| 1,247,809 | 11/1917 | Foster . | |
| 1,300,640 | 4/1919 | Pasternak . | |
| 1,352,047 | 9/1920 | Boje, Jr. . | |
| 1,356,817 | 10/1920 | Gregory | 273/58 B |
| 1,969,128 | 8/1934 | Harrison . | |
| 2,149,616 | 3/1939 | McGuire . | |
| 2,324,277 | 7/1943 | Casey et al. | 273/58 K |
| 2,373,529 | 4/1945 | Beal | 446/220 X |
| 2,516,552 | 7/1950 | Clark et al. | 446/226 |
| 2,688,394 | 2/1954 | Auzin . | |
| 2,698,496 | 1/1955 | Miller | 446/226 |
| 2,942,379 | 6/1960 | Oman et al. . | |
| 2,952,460 | 9/1960 | Ellis . | |
| 2,960,794 | 11/1960 | Johns . | |
| 3,601,923 | 8/1971 | Rosenberg . | |
| 3,650,530 | 3/1972 | Gantz . | |
| 3,734,498 | 5/1973 | Seiersen . | |
| 4,034,495 | 7/1977 | Lemelson . | |
| 4,169,336 | 10/1979 | Kuhn . | |
| 4,268,030 | 5/1981 | Richards . | |
| 4,354,679 | 10/1982 | Steinmetz . | |
| 4,781,645 | 11/1988 | Kato | 446/221 X |

FOREIGN PATENT DOCUMENTS

| | | | |
|---|---|---|---|
| 40-27321 | 9/1965 | Japan | 446/226 |
| 57-19184 | 4/1982 | Japan | 446/226 |
| 57-59188 | 12/1982 | Japan | 446/226 |
| 236505 | 7/1925 | United Kingdom . | |

*Primary Examiner*—Peter R. Brown

*Attorney, Agent, or Firm*—David A. Burge

[57] ABSTRACT

A self-inflating toy that provides amusement before and during inflation as well as after. The toy is formed from relatively flexible materials that define a sealed inner chamber which contains mixable chemicals that are separated by a membrane which is ruptured when the deflated toy is struck a firm blow. Upon rupture of the membrane, the chemicals mix and react to produce a gas that causes the toy to inflate as the sealed chamber becomes pressurized by the gas. In its deflated form, the toy is collapsed to assume a relatively flat, essentially two-dimensional state, thereby enabling it to fit inside an envelope or other essentially flat paper container in much the same manner as a greeting card. In one preferred form, the toy has three-dimensional outer surface portions that are printed and/or textured to provide features that attract attention such as a grimacing face that has expressions which change and are enhanced as the toy expands from a deflated state to its fully inflated state. The inflation of the toy may be rendered even more entertaining by incorporating within its structure components that have surface portions that engage and move relative to each other during inflation of the toy to generate various types of entertaining noises. Once inflated, the toy retains its inflated form to provide lasting amusement.

10 Claims, 4 Drawing Sheets

SELF-INFLATING TOY

CROSS-REFERENCE TO RELATED APPLICATION

This application is a continuation of application Ser. No. 103,025 filed Sept. 30, 1987 now abandoned as a continuation of application Ser. No. 879,915 filed June 27, 1986 now abandoned. The benefit of the filing dates of the previously-filed applications is claimed.

BACKGROUND OF THE INVENTION

1. Field of the Invention

The present invention relates to an inflatable toy that incorporates features which provide amusement before, during and after the toy is inflated from a collapsed state to an expanded state, and that has a self-inflating action which is triggered by a predetermined stimulus such as the striking of a blow to the toy to rupture an internal barrier that separates chemicals which, when mixed, generate a gas that pressurizes a sealed interior chamber of the toy to effect its inflation.

2. Prior Art

Inflatable toys are known that are designed to be shipped in a collapsed, basically deflated state, and inflated either by a retailer or by an end purchaser. The major reason for shipping such toys in a deflated state is to minimize occupied volume so that a maximum number of the toys can be packaged in a minimum of space for shipment and storage.

Some known types of inflatable toys are intended to retain their inflated state substantially indefinitely once they have been inflated. Others are provided with valves of various sorts to enable the toys to be deflated, re-inflated and/or supplementally inflated.

It has been proposed to provide inflatable toys of various forms with outer surface formations that define entertaining features such as deformed or grimaced facial features and the like. It also has been proposed to use thin, pliable, resilient materials to form these entertaining outer surface features. Some proposals call for the entertaining features to vary in configuration or prominence depending on the degree to which the toys are inflated, i.e., the extent to which internal chambers within the toys are pressurized.

Self-inflating articles of various types also are known, typical among these being toys such as figurines, and flotation devices such as rafts, life preservers, and the like. Some of these articles utilize canisters of pressurized gas that are opened to effect inflation. Others utilize chemical reactions of various types to generate pressurizing gases.

Previously proposed self-inflating articles are not intended to be "entertaining" or "amusing" before or during inflation, but rather are shipped and stored in a deflated state to minimize the space they occupy, and are provided with self-inflating capabilities for convenience in effecting relatively rapid inflation without requiring the expenditure of significant effort or the use of auxiliary equipment. By way of example, passengers who are fleeing a sinking conveyance find the inflation of a life raft "interesting" only to the extent that the inflation process takes place rapidly so as to provide for their escape—the hope being that the raft will inflate with dispatch, not that it will inflate in a manner that is "amusing."

SUMMARY OF THE INVENTION

The present invention addresses needs that are not addressed by inflatable toys of prior proposals, by providing a self-inflating toy that has features which render interesting and amusing the very process of the toy's inflation, and with the toy having entertaining configurations before, during and after inflation.

In accordance with the preferred practice of the present invention, a self-inflating toy has molded outer surface portions that are printed and/or textured to provide an entertaining appearance, design or expression such as a grimacing face, the expressions of which change and are progressively enhanced as the toy progressively expands from a deflated state to a fully inflated state. The inflation of the toy may be rendered even more entertaining by incorporating in its structure components that have surface portions which engage and move relative to each other to generate a variety of noises during the inflation of the toy. Once inflated, the toy retains its inflated form to provide lasting interest and amusement.

In preferred practice, a toy embodying the invention is formed from relatively flexible materials that define a sealed inner chamber which contains mixable chemicals that are separated by a membrane which is ruptured when the deflated toy is struck a firm blow. When the membrane is ruptured by striking the deflated toy, the chemicals within the sealed chamber mix and react to produce a gas that causes the toy to inflate as the sealed chamber is pressurized by the gas. In its deflated form, the toy is collapsed to a relatively flat state, enabling it to be carried inside an envelope or other essentially flat paper container in much the same manner as a greeting card.

Outer surface portions of the self-inflating toy are rendered entertaining, amusing and/or attractive by molding or otherwise forming selected surface portions to incorporate three-dimensional features, and by printing or otherwise decorating the three-dimensional features to add color, texture and a more realistic "feel." Thus outer surface portions are provided with features that are interesting both visually and tactilely.

Amusement is provided during the process of inflation by the changing appearance of the outer surface features, and preferably also by the generation of accompanying noises. The noises may be generated by providing two or more layers of material that have portions which rub across each other as they move relative to each other during inflation, or by other common noise-generating means. Creaking, rubbing, popping and squeaking noises can be generated with ease using various relatively movable materials, as will be understood by those who are skilled in the art.

The appearance of a toy that embodies the present invention preferably is designed to undergo attention-attracting transformations during the process of inflation. For example, facial features that change expression as the toy is inflated are quite entertaining to watch.

In its fully inflated state, a toy that embodies the preferred practice of the present invention is intended to provide lasting amusement via its appearance and configuration, and by the "feel" of its outer surface. While the toy is preferably formed from materials that will retain the pressure of an inflating gas therein, an auxiliary valve may be carried by the toy to provide for deflation, re-inflation, and/or supplemental inflation using an external source of compressed gas.

BRIEF DESCRIPTION OF THE DRAWINGS

These and other features, and a fuller understanding of the invention may be had by referring to the following description and claims taken in conjunction with the accompanying drawings wherein:

DESCRIPTION OF THE PREFERRED EMBODIMENT

Figure 1:
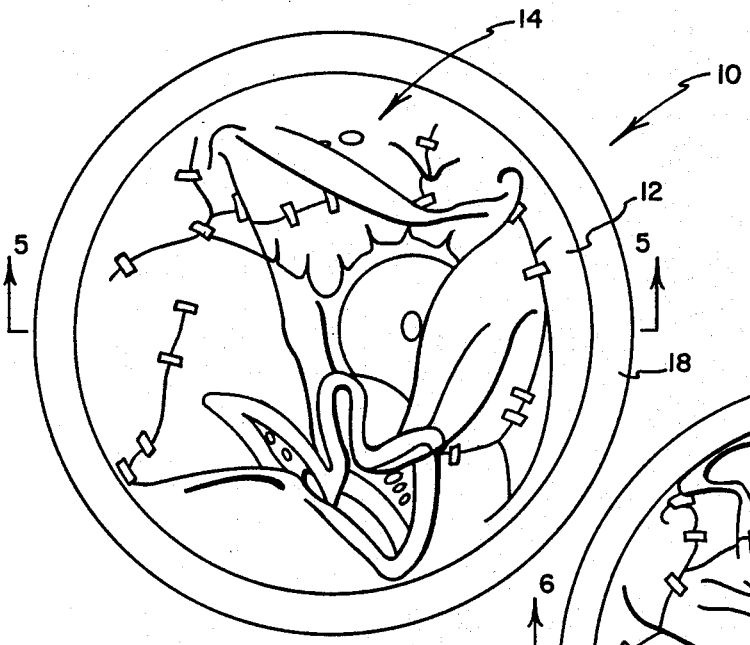
FIG. 1 is a top plan view of a self-inflating toy ball that embodies the preferred practice of the present invention, with the ball being depicted in an essentially deflated state.
Figure 2:
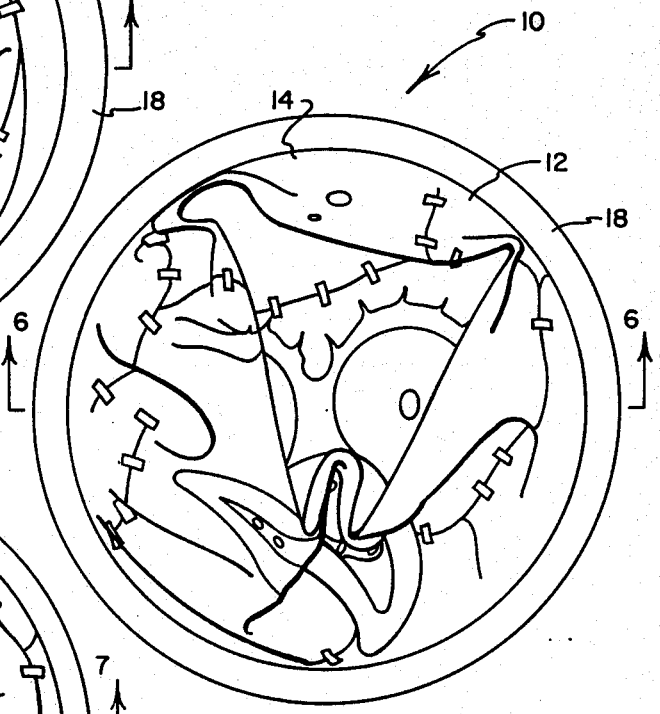
FIG. 2 is a top plan view of the ball of FIG. 1 during an early stage of inflation.
Figure 3:
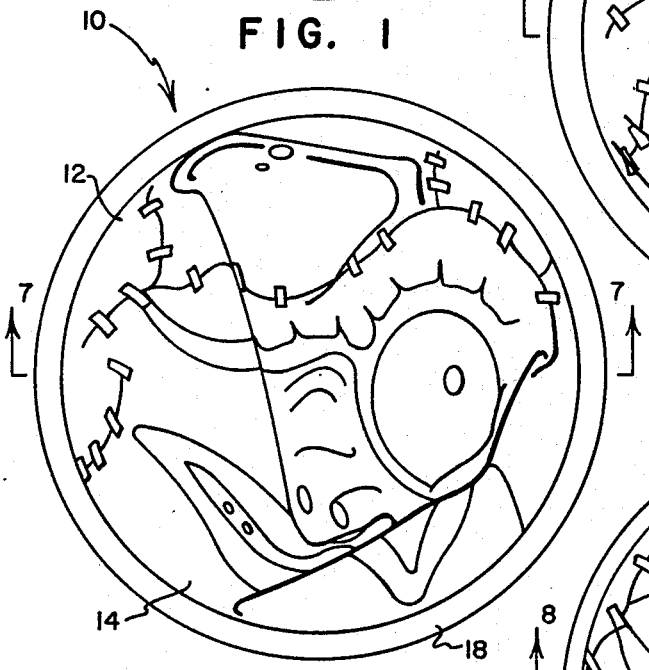
FIG. 3 is a top plan view thereof as the toy ball is about midway through the inflation process.
Figure 4:
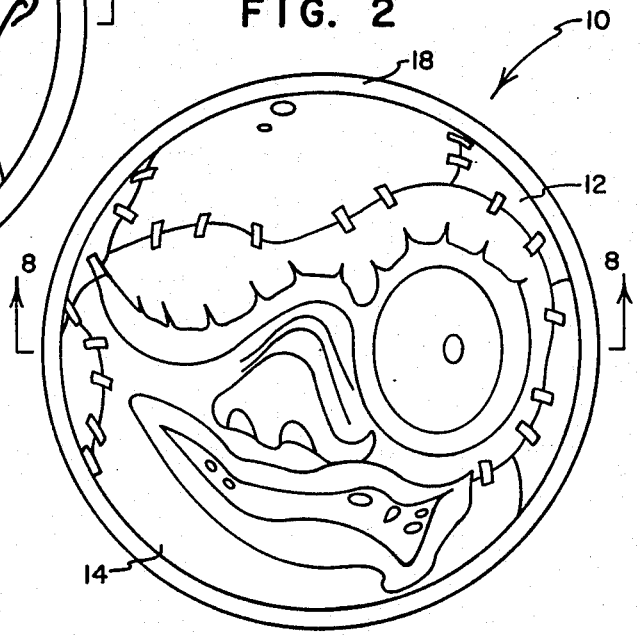
FIG. 4 is a top plan view of the toy ball in its fully inflated state.
Figure 5:
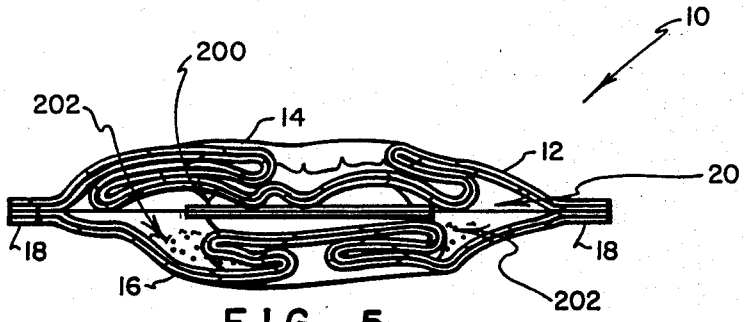
FIG. 5 is a sectional view as seen from a plane indicated by a line 5—5 in FIG. 1.
Figure 6:
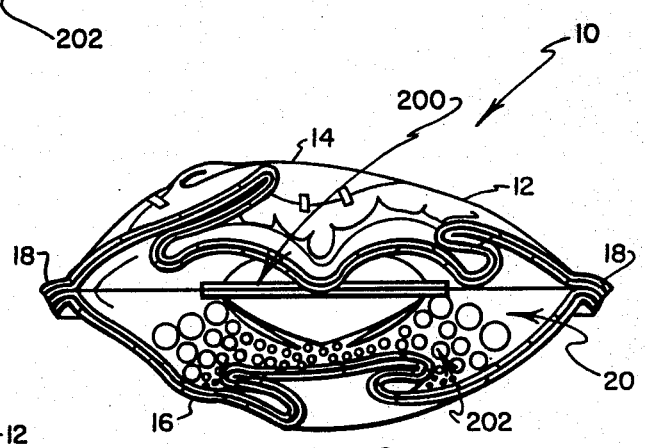
FIG. 6 is a sectional view as seen from a plane indicated by a line 6—6 in FIG. 2.
Figure 7:
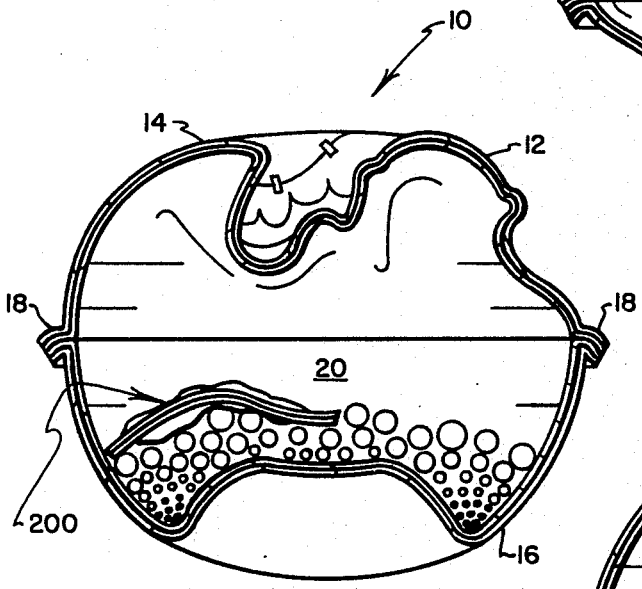
FIG. 7 is a sectional view as seen from a plane indicated by a line 7—7 in FIG. 3.
Figure 8:
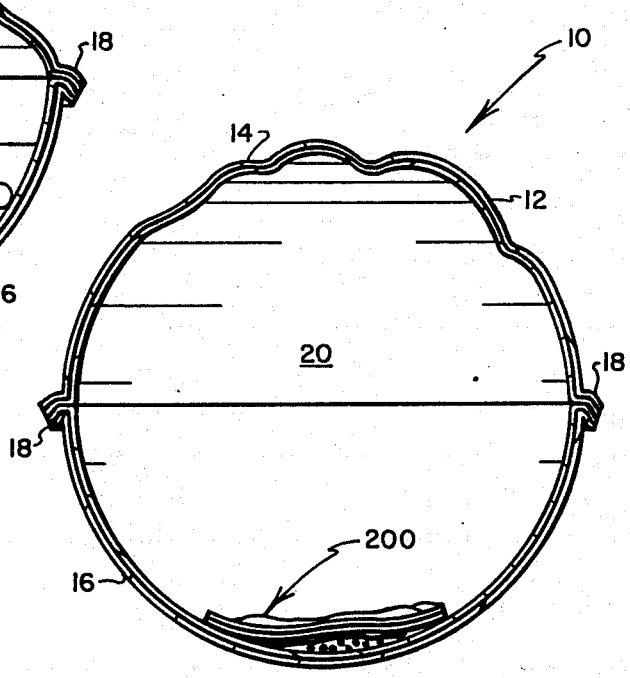
FIG. 8 is a sectional view as seen from a plane indicated by a line 8—8 in FIG. 4.

Referring to FIGS. 1 through 4 (and to the sectional views of FIGS. 5 through 8 that are taken, respectively, from FIGS. 1 through 4), a self-inflating toy embodying the preferred practice of the present invention is shown in the form of a ball which is indicated generally by the numeral 10. The ball 10 initially takes a relatively flat, essentially two-dimensional form that will be referred to as its "deflated form," which is depicted in FIG. 1. Inflation of the ball 10 takes place progressively, successive partially inflated states being illustrated in FIGS. 2 and 3, and with the final fully inflated state of the ball 10 being shown in FIG. 4. An examination of the sectional views of FIGS. 5, 6, 7 and 8 will aid the reader in understanding how the inflation of the ball 10 proceeds progressively from the deflated state of FIG. 1 to the fully inflated state of FIG. 8.

Figure 9:
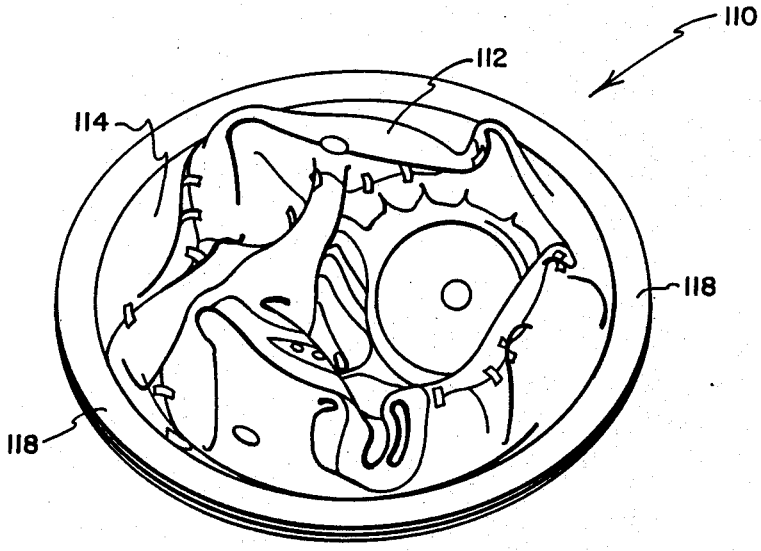
FIG. 9 is a perspective view of an alternate form of inflatable toy ball that embodies features of the preferred practice of the invention, with the components of the ball being shown deflated.
Figure 10:
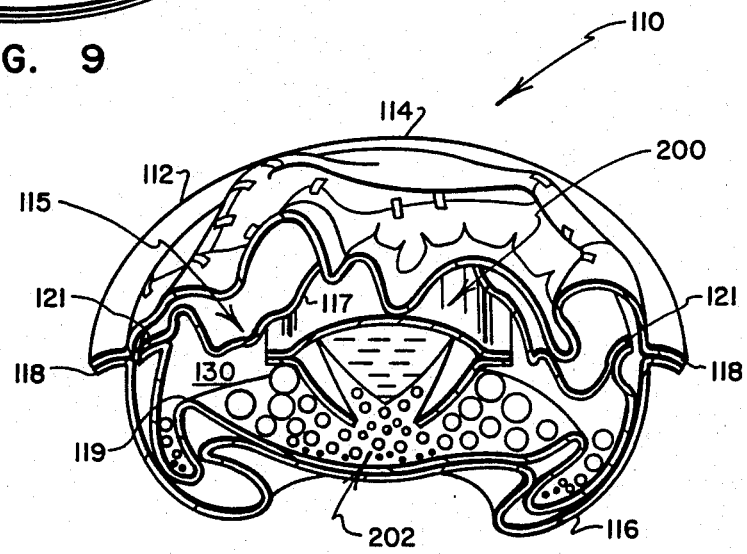
FIG. 10 is a perspective view showing the ball of FIG. 9 at about midway during the inflation process, with portions of the ball being broken away to permit interior features to be viewed.
Figure 11:
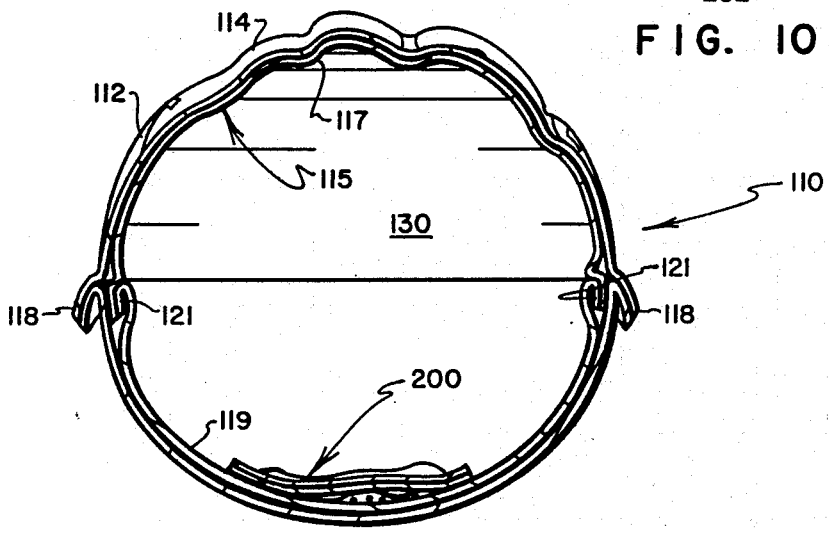
FIG. 11 is a sectional view similar to FIG. 8 but showing internal features of the ball of FIGS. 9 and 10, with the ball in an inflated state.
Figure 12:
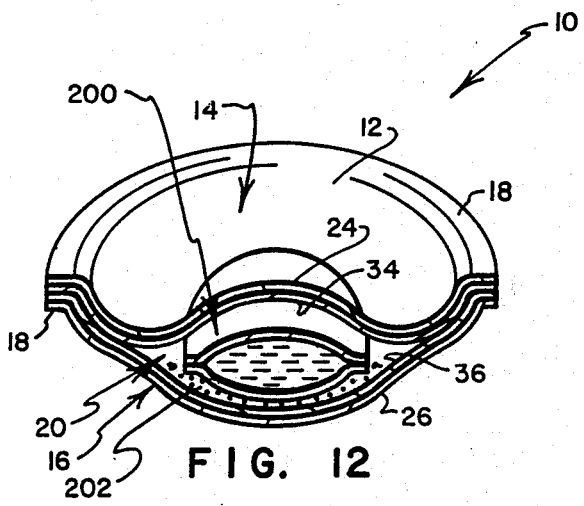
FIG. 12 is a highly schematic sectional view depicting features of the ball embodiment of FIGS. 1–8, with the components of the ball being illustrated prior to initiation of the self-inflation process.
Figure 13:
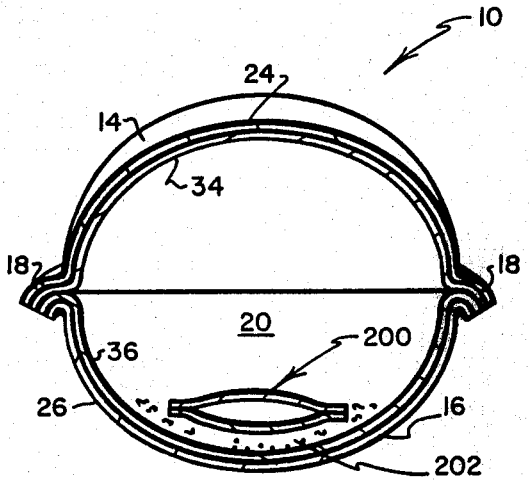
FIG. 13 is a schematic sectional view similar to FIG. 12 but with the ball fully inflated.
Figure 14:
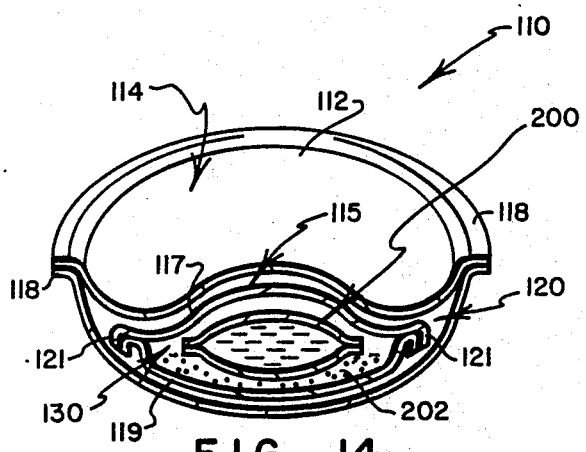
FIG. 14 is a schematic sectional view similar to FIG. 12 but depicting features of the ball embodiment of FIGS. 9–11 prior to initiation thereof; and, FIG. 15 is a schematic sectional view similar to FIG. 14 but with the ball being fully inflated.
Figure 15:
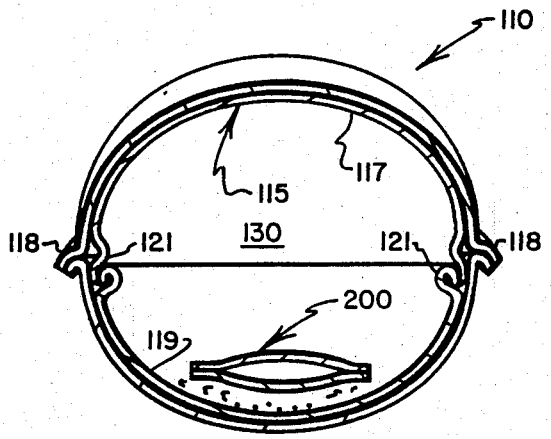

For purposes of overview, reference is made briefly to FIGS. 12 and 13 that schematically illustrate the ball embodiment 10 of FIGS. 1 through 8 in its deflated and fully inflated states, respectively; and to FIGS. 14 and 15 that schematically illustrate an alternate ball embodiment 110 in its deflated and fully inflated states, respectively, with details of the construction of the alternate ball embodiment 110 being illustrated in FIGS. 9 through 11.

Referring to FIGS. 12 and 13, the ball 10 has an outer surface 12 that is formed from a pair of generally semispherically shaped members 14, 16 that have been vacuum formed or otherwise shaped to depict such novelty features as facial portions of a creature, with the depicted facial portions combining to provide a relatively grimaced expression.

The members 14, 16 are sealed along a circumferentially extending line of junction that is indicated by the numeral 18, whereby the members 14, 16 cooperate to define a sealed chamber 20 interiorally of the ball 10. It is the chamber 20 that is pressurized by an inflating gas to expand the ball 10 from its deflated state shown in FIG. 1 to its fully inflated state shown in FIG. 4, as will be explained.

The semispherically shaped members 14, 16 are dual-layered in character, with the member 14 having an outer layer 24 and an inner layer 34, and with the member 16 having an outer layer 26 and an inner layer 36. As depicted, the inner and outer layers 24, 34 and 26, 36, are bonded together, respectively, so that the inner and outer layers 24, 26 and 34, 36 of the members 14, 16 move in unison during inflation of the ball 10 as though the members 14, 16 were of single-layer structure. A principal purpose for providing dual-layer structures for the members 14, 16 is to enhance the impermeability of the members 14, 16 to such inflating gas as may be deployed in the chamber 20 to expand and inflate the ball 10. Depending on the character of the material or materials that are used to form the members 14, 16, the use of a plurality of layers may be quite unnecessary; however, it is presently believed that the use of a plurality of layers is desirable to maximize the ability of the ball 10 to retain its inflated state over long periods of time.

Referring to FIGS. 14 and 15, the ball 110 is depicted as being formed from a pair of semispherically shaped members 114, 116 that are of single-layer construction. The members 114, 116 are sealed about a circumferentially extending line of juncture 118, and cooperate to define a sealed chamber 120 interiorally of the ball 110. However, a separate bladder 115 is carried within the chamber 120, with the bladder 115 being formed by a pair of members 117, 119 which are perimetrically sealed along a line indicated by a numeral 121 to define a sealed chamber 130 within the bladder 115. It is the inner chamber 130 that receives inflating gas to expand the ball 110, as will be explained.

Housed within each of the chamber 20 (of the ball 10) and the inner chamber 130 (of the ball 110) is a packet of liquid 200 and a quantity of powder 202. The packet of liquid 200 is preferably provided with a thin wall or a line of weakness (not shown) that will enable the packet of liquid 200 to burst readily in response to a blow being struck to its associated ball 10, 110, whereby the liquid from the packet 100 and the powder 202 are caused to mix and to react to generate an inflating gas that pressurizes the associated chamber 20, 130 to inflate and expand the associated ball 10, 110.

In preferred practice, the chemicals that are used to generate an inflating gas are relatively common, relatively harmless substances such as lemon juice and baking powder, known more specifically as citric acid and sodium bicarbonate. Other acid/base reaction chemicals that produce harmless inflating gases such as carbon dioxide may also be used, as will be understood by those skilled in the art.

The liquid containing packet 200 is designed such that when either of the self-inflating balls 10, 110 are struck firmly with one's fist while the ball is in a deflated condition, the packet 200 is caused to burst, whereby the liquid contained in the packet is discharged into the powder and reacts with the powder to produce a gas such as carbon dioxide that inflates and pressurizes either the associated chamber 20 or the inner chamber 130 of the bladder 115. Where the bladder 115 is employed, its walls 117, 119 are free to move within the confines of the walls 114, 116 and this has the advantage of causing noises of an interesting character to be generated as the materials screech, scrape, and slide across each other, with some occasional tendency to stick together momentarily that eventually results in a kind of popping noise and a shaking of the ball as the inflation process proceeds.

The outer wall members 14, 16 and 114, 116 preferably are vacuum formed, molded or otherwise shaped to define three-dimensional portions that have an entertaining appearance, for example by defining a face that has grimaced facial features forming a weird or bizarre expression. As the expansion of the balls 10, 110 proceeds, the expressions provided by the surface features are caused to change, and in many instances are found to be surprisingly enhanced. As the inflation progresses and as new facial features or the like become exposed, often it is found that the kind of facial feature that is thought to be unfolding or developing turns into an entirely different form of feature. All in all, the inflation process, which preferably takes somewhere within the range of about 15 seconds to about 2 minutes to complete, is quite an interesting spectacle to observe.

Preferably, the chemicals that react to generate the gas are common, relatively harmless substances such as lemon juice and baking powder (i.e., citric acid and sodium bicarbonate), whereby neither the chemicals nor the resulting products of their reaction (including the carbon dioxide gas that inflates the ball) present a danger should they leak or escape.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A hollow self-inflatable amusement device comprising, a sealed hollow structure for flexible material which when inflated defines a substantially ball-like configuration, said structure being formed from a pair of superposed sheets of said flexible material, said sheets being free of apertures or access openings over the surfaces thereof, said sheets having a peripheral bonded seam joining the sheets together, with each sheet having excess material lying in non-planar relation within the seam periphery when said structure is in a non-inflated and generally collapsed state, said excess material of said superposed bonded sheets in said non-inflates state including opposed outwardly convex generally part-spherical surfaces within the perimeter of said peripheral seam, thereby together with said peripheral seam defining a configuration which is substantially self-sustaining for ready handling and manipulation prior to impact and inflation, normally inactive gas-generating means including a rupturable container containing a gas-generating chemical received within said hollow structure between said sheets, said gas-generating means being responsive to impact pressure forces against the surfaces of said sheets to rupture said container and cause generation of a gas by said gas-generating means within said hollow structure to inflate the same, said sheets and said gas-generating means cooperating to preclude rupture of said sheets under said impact forces thereby to maintain the integrity of said sealed hollow structure, said gas-generating means controllably generating said gas following impact over a period from about 15 seconds to 2 minutes, thereby slowly inflating said hollow structure from the initial configuration thereof including said excess material inwardly of the sheet periphery to a final inflated form of generally ball-like appearance with a taut, generally smooth and unfolded surface, thereby permitting protracted observation thereof during inflation for amusement and interest, and, said flexible material being substantially impervious to rapid leakage transmission of said gas therethrough, thereby to maintain the inflated configuration for a substantial period of time for observation, handling and enjoyment.

2. The device of claim 1 wherein the gas-generating means includes quantities of mixable chemicals which, when mixed, react to produce said inflating gas, and wherein said envelope defines separator means for separating the mixable chemicals to prevent their being mixed except in response to said impact pressure forces.

3. The inflatable device of claim 2 wherein the quantities of mixable chemicals included an acid and a base which, when mixed, react to produce said inflating gas.

4. The inflatable device of claim 3 wherein the acid includes citric acid, and the base includes sodium bicarbonate.

5. The inflatable device of claim 1 wherein each said flexible sheet of material includes a pair of layers of thin flexible material that extend substantially coextensively in overlying relationship, with at least one of the layers of each said pair being formed from a material that is substantially impervious to the inflating gas.

6. The inflatable device of claim 5 wherein the layers of said pair are bonded together at spaced locations to enable portions of the layers that extend between the bonded locations to move relative to each other during inflation of the toy.

7. The inflatable device of claim 5 wherein the pair of layers includes an inner layer that is formed from said gas-impervious material and that defines a sealed chamber between the sheets, and an outer layer that surrounds the inner layer and defines said outer surface features.

8. The inflatable device of claim 7 wherein the inner layer and the outer layer are not bonded to each other whereby, during inflation of the toy, the materials of the inner and outer layers move relative to each other.

9. The inflatable device of claim 8 wherein the materials of the inner and outer layers are selected and arranged so that the relative movement that takes place between these materials during inflation of a sealed hollow structure between the sheets causes noise to be produced.

10. The inflatable device of claim 1 wherein said gas-generating means includes a chemical powder confined between the sheets and said chemical in said envelope is a liquid.

* * * * *